US008324816B2

(12) United States Patent
Ohashi et al.

(10) Patent No.: US 8,324,816 B2
(45) Date of Patent: Dec. 4, 2012

(54) LED DRIVING CIRCUIT

(75) Inventors: Mitsuo Ohashi, Nagano (JP); Iwao Sagara, Nagano (JP); Hideyuki Komatsu, Nagano (JP)

(73) Assignee: Koa Corporation, Ina-shi (JP)

( * ) Notice: Subject to any disclaimer, the term of this patent is extended or adjusted under 35 U.S.C. 154(b) by 546 days.

(21) Appl. No.: 12/442,830

(22) PCT Filed: Oct. 17, 2007

(86) PCT No.: PCT/JP2007/070676

§ 371 (c)(1),
(2), (4) Date: Aug. 12, 2009

(87) PCT Pub. No.: WO2008/050779

PCT Pub. Date: May 2, 2008

(65) Prior Publication Data

US 2010/0072898 A1 Mar. 25, 2010

(30) Foreign Application Priority Data

Oct. 18, 2006 (JP) ..... 2006-283612
Feb. 2, 2007 (JP) ..... 2007-024042
Feb. 21, 2007 (JP) ..... 2007-040831

(51) Int. Cl.
*H05B 37/00* (2006.01)
*H05B 41/00* (2006.01)

(52) U.S. Cl. ..... 315/127; 315/122; 315/185 R

(58) Field of Classification Search ..... 315/127, 315/186, 209 R, 224, 225, 291, 307, 244, 315/245, 247, 308, 122, 297, 185 R, 360–362; 345/82, 83, 39, 44, 46
See application file for complete search history.

(56) References Cited

U.S. PATENT DOCUMENTS 3,796,951 A * 3/1974 Joseph ..... 324/122
4,633,217 A * 12/1986 Akano ..... 340/12.36
(Continued)

FOREIGN PATENT DOCUMENTS

JP 2006-278526 A 10/2006

OTHER PUBLICATIONS

International Search Report of PCT/JP2007/07676, Mailing Date of Feb. 12, 2008.

*Primary Examiner* — Thienvu Tran
(74) *Attorney, Agent, or Firm* — Westerman, Hattori, Daniels & Adrian, LLP

(57) ABSTRACT

An LED driving circuit is provided for making it possible to economically drive a serially connected LED circuit by means of a switching device with a relatively low withstanding voltage even if the number of serially connected LED devices increases. In an LED driving circuit provided with a serially connected LED circuit (11) in which many LED devices are serially connected and a switching device (13) serially connected with the serially connected LED circuit (11) to control that an electrical current flowing through the serially connected LED circuit (11) is turned on or off, wherein a circuit device (15), which comprises a resistor, a constant voltage diode, a constant current diode, or the like, is connected in parallel with the switching device to make a minute current flow through the serially connected LED circuit (11) to the extent that the LED devices are not turned on when the switching device is turned off.

6 Claims, 9 Drawing Sheets

U.S. PATENT DOCUMENTS

| | | | | |
|---|---|---|---|---|
| 4,723,312 | A * | 2/1988 | Yamashita et al. | 398/182 |
| 5,400,086 | A * | 3/1995 | Sano et al. | 348/678 |
| 6,351,079 | B1 * | 2/2002 | Willis | 315/200 A |
| 6,430,071 | B1 * | 8/2002 | Haneda | 363/127 |
| 7,518,319 | B2 * | 4/2009 | Konno et al. | 315/291 |
| 7,864,142 | B2 * | 1/2011 | Tanahashi et al. | 345/82 |
| 2007/0013620 | A1 * | 1/2007 | Tanahashi et al. | 345/82 |
| 2007/0085489 | A1 * | 4/2007 | Robinson et al. | 315/224 |
| 2007/0108916 | A1 * | 5/2007 | Wang et al. | 315/247 |
| 2008/0068298 | A1 * | 3/2008 | Shen et al. | 345/46 |
| 2008/0231193 | A1 * | 9/2008 | Kuwana | 315/77 |
| 2009/0021182 | A1 * | 1/2009 | Sauerlaender | 315/291 |
| 2009/0190065 | A1 * | 7/2009 | Konno et al. | 349/61 |
| 2010/0072898 | A1 * | 3/2010 | Ohashi et al. | 315/127 |
| 2010/0194301 | A1 * | 8/2010 | Okubo | 315/224 |
| 2011/0156603 | A1 * | 6/2011 | Ko et al. | 315/307 |
| 2012/0032614 | A1 * | 2/2012 | Su et al. | 345/82 |
| 2012/0098462 | A1 * | 4/2012 | Inoue et al. | 345/102 |
| 2012/0139420 | A1 * | 6/2012 | Lee et al. | 345/82 |

* cited by examiner

LED DRIVING CIRCUIT

TECHNICAL FIELD

The present invention relates to an LED driving circuit, which controls an electrical current flowing through a serially connected LED circuit, in which many LED devices are serially connected, and which turns on and off the many LED devices with all together.

BACKGROUND ART

Heretofore, upon a lighting equipment and so on, there has been used that a plurality of serially connected LED circuits, in which many LED devices are serially connected, is connected in parallel, and an electrical current flowing through the plurality of serially connected LED circuits is turned on and off by using a switching device (transistor) so as to control turning on and off the many LED devices with all together (see, for example, Japanese laid-open patent publication No. 2001-15278, No. 2003-100472, No. 2003-139712, No. 2005-50704).

FIG. 1 is a view showing a conventional general structure of such an LED driving circuit. A serially connected LED circuit 11 is formed by connecting many LED devices in series, and DC power supply 12 and a switching device 13 are connected in series with the serially connected LED circuit 11. A control circuit 14 is connected to a control terminal (base terminal) of the switching device (transistor) 13 and a control signal is supplied for turning on and off the switching device 13. When an on-signal voltage is supplied to the switching device 13, the switching device 13 between a collector and an emitter becomes on-state, and an electrical current is supplied from DC power supply 12 to flow through the many LED devices to turning on with all together. When an off-signal voltage is supplied to the switching device 13, the switching device 13 between the collector and the emitter becomes off-state, and the electrical current from the power supply 12 is shut off to turning off the many LED devices with all together.

DISCLOSURE OF INVENTION

However, upon the lighting equipment and so on, it is preferable that as many series-parallel connected LED devices as possible can be driven by as few switching devices (transistors) as possible, from a view point for securing illumination light volume and economics of the driving circuit.

Further, upon the lighting equipment and so on, it is preferable that brightness of the LED light source can be controlled widely, for example, from dim state to fully bright state.

Further, upon the lighting equipment and so on, there is a problem that wiring length tends to be longer since many LED devices are series-parallel connected, stray inductance and stray capacitance tends to be large, and high speed switching control of turning on and off the LED devices with narrow width current pulse, for example, units of 10 nS, tends to be difficult.

The present invention has been made in view of the above problems. It is first object of the present invention to provide an economical LED driving circuit, which can drive many serially connected LED devices by using relatively low withstanding voltage switching device, even if the number of serially connected LED devices increases.

Also, it is second object of the present invention to provide an LED driving circuit, which can adjust electrical current range from small current range to large current range, and in which fine adjustment of the electrical current can be possible, so as to change LED light volume widely and accurately.

Further, it is third object of the present invention to provide an LED driving circuit, in which high-speed control of turning on and off the LED devices can be possible with using narrow width current pulse, for example, units of 10 nS, and precisely controlled current can be supplied for flowing through the serially connected LED circuit.

There is provided, in accordance with a first aspect of the present invention, an LED driving circuit, which comprises a serially connected LED circuit, in which many LED devices are serially connected; and a switching device serially connected with the serially connected LED circuit to control that an electrical current flowing through the serially connected LED circuit is turned on or off; wherein a circuit device is connected in parallel with the switching device to make a minute current flow through the serially connected LED circuit to the extent that the LED devices are not turned on when the switching device is turned off. The circuit device is a resistor device, a constant voltage diode device, a constant current diode device, or the like.

According to the LED driving circuit of the present invention, when the switching device is turned off, a minute current flows through the circuit device, which is connected in parallel with the switching device, to the extent that the LED devices are not turned on. Accordingly, a voltage drop is generated along serially connected LED devices, and applied voltage to the switching device is reduced by the voltage drop. Therefore, a switching device with low applicable maximum voltage $V_{CEO}$ can be adopted, and it makes possible to produce an economical LED driving circuit, which can drive many serially connected LED devices by using relatively low withstanding voltage switching device.

There is provided, in accordance with a second aspect of the present invention, an LED driving circuit, which comprises a serially connected LED circuit, in which many LED devices are serially connected; a first switching device serially connected with the serially connected LED circuit to control an electrical current flowing through the serially connected LED circuit; a current setting resistor circuit, which comprises a plural of resistors connected in parallel with each other between the first switching device and a ground terminal, and second switching devices, each of which is serially connected with each of the plural of resistors; and a setting circuit for setting on or off of the second switching devices respectively. Further, an output of a buffer amplifier is connected with a control terminal of the first switching device, and an output of a multiplexer is connected with an input of the buffer amplifier. And, an output of a D/A converter is connected with one input terminal of the multiplexer, and a ground voltage is connected with the other input terminal of the multiplexer According to the LED driving circuit of the present invention, by providing with a plural of resistors connected in parallel with each other, and second switching devices, each of which is serially connected with each of the plural of resistors, and a setting circuit for setting on or off of the second switching devices respectively, a synthetic resistance between the first switching device connected with the serially connected LED circuit and the ground terminal can be changed widely. Therefore, current ranges of the electrical current flowing through the serially connected LED circuit can be adjusted widely from small current to large current. And, by connecting an output terminal of a D/A converter with one input terminal of the multiplexer, and supplying a variable voltage from the D/A converter to the control terminal (base terminal) of the first switching device when LED devices are turned on, fine adjustment of an electrical current flowing through the serially connected LED circuit can be possible. Further, by connecting a ground voltage with the other input terminal of the multiplexer, and supplying GND voltage to the control terminal of the first switching device, an electrical current flowing through the serially connected LED circuit can be shut off immediately.

There is provided, in accordance with a third aspect of the present invention, an LED driving circuit, which comprises a serially connected LED circuit, in which many LED devices are serially connected; a first switching device serially connected with the serially connected LED circuit to control an electrical current flowing through the serially connected LED circuit; a switching device cascade connected with the first switching device, the switching device connected between the serially connected LED circuit and the first switching device; a current setting resistor device connected between the first switching device and a ground terminal; a buffer amplifier connected with a base terminal of the first switching device; a multiplexer connected with an input of the buffer amplifier to switch LED on signal and off signal; and a lighting time control circuit to form times of the LED on signal and off signal.

According to the LED driving circuit of the present invention, it makes high-accuracy and wide-range on and off of current pulses, which are supplied to the serially connected LED circuit, possible by using high-speed multiplexer and wide frequency band buffer amplifier, by switching LED on signal and off signal with a lighting time control circuit, and by providing with a switching device cascade connected with the first switching device.

BEST MODE FOR CARRYING OUT THE INVENTION

Figure 1:
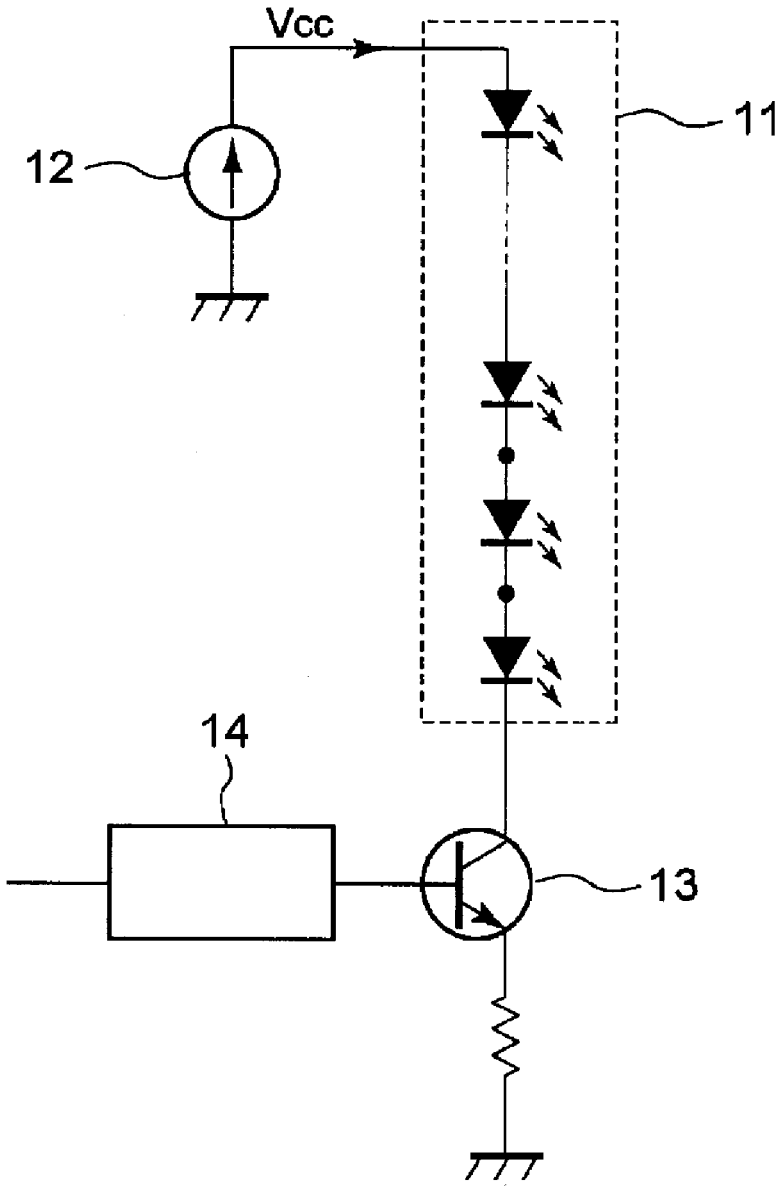
FIG.1 PRIOR ART
FIG. 1 is a circuit diagram showing a conventional LED driving circuit.

Embodiments of the present invention will be described in detail below with reference to the drawings. Like or corresponding parts will be denoted and will be described by the same reference characters throughout views.

According to the conventional LED driving circuit shown in FIG. 1, when switching device 13 is off, almost same voltage with power supply voltage Vcc of the DC power supply 12 is applied to the switching device 13 between the collector and the emitter. When number (n) of serially connected LED devices increases for making brightness up and the like, the DC power supply voltage is required to increase since a relationship "DC power supply voltage Vcc>number (n) of serially connected LED devices x Forward voltage (Vf) of an LED device" must be satisfied. Here, when the power supply voltage Vcc increases over than a condition that as to applicable maximum voltage of the switching device Vceo, $$Vceo<Vcc,$$

when the electrical current is off, almost same voltage with the power supply voltage Vcc is applied to the switching device 13 between the collector and the emitter, the power supply voltage Vcc exceeds the applicable maximum voltage Vceo and then the switching device 13 will be damaged and destroyed.

Thus, the first embodiment of the LED driving circuit of the present invention can reduce the voltage, which is applied to the switching device 13 when the switching device 13 is off, and it can make possible to use relatively low withstanding voltage switching device. That is, to produce an economical LED driving circuit, in which, even if number (n) of serially connected LED devices increases, and relating to this, the power supply voltage Vcc increases over than applicable maximum voltage Vceo of the switching device, the voltage applied to the switching device can be reduced, and the switching device can be prevented from damaged and destroyed.

Figure 2:
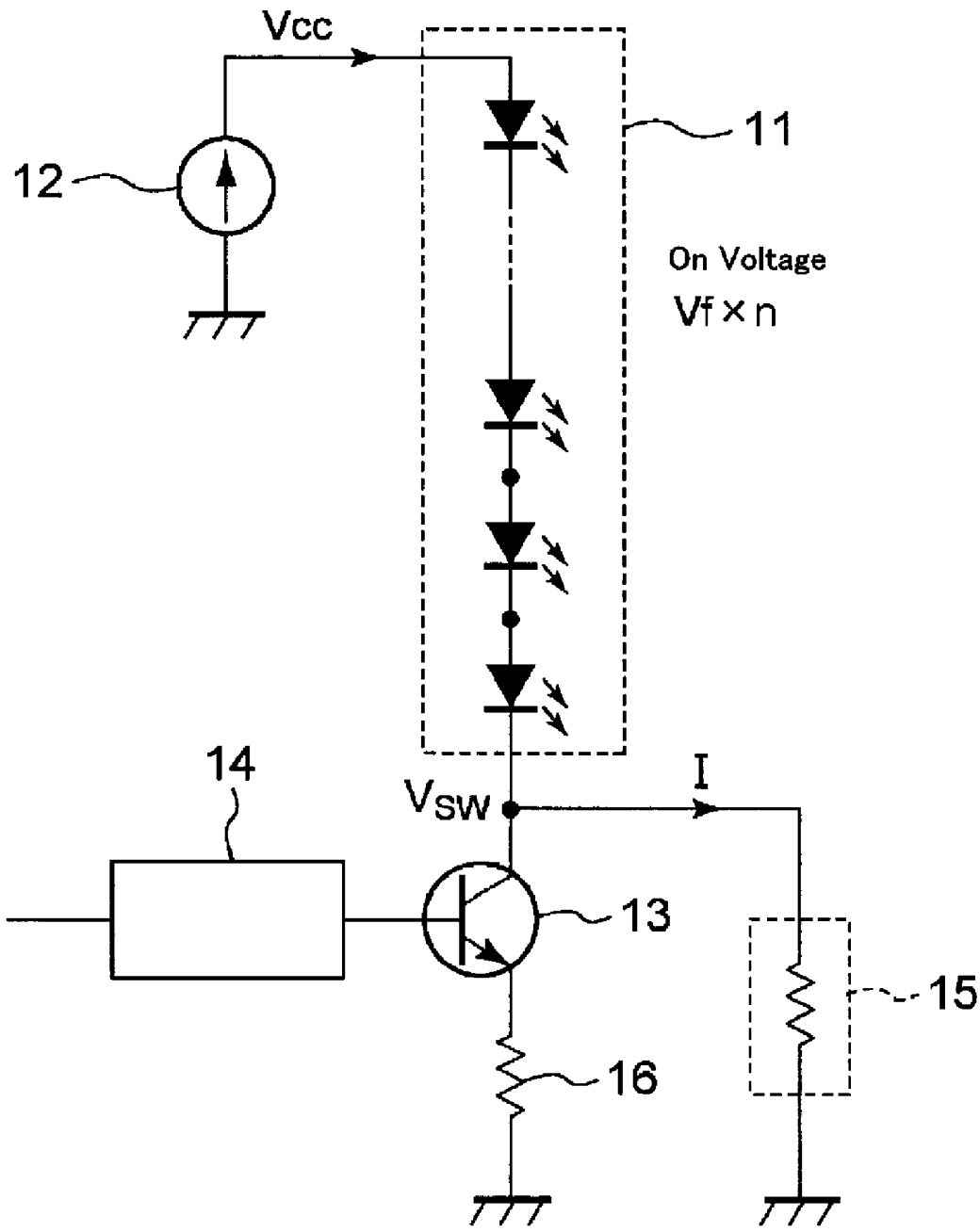
FIG. 2 is a circuit diagram showing an LED driving circuit according to a first embodiment of the present invention.
Figure 3:
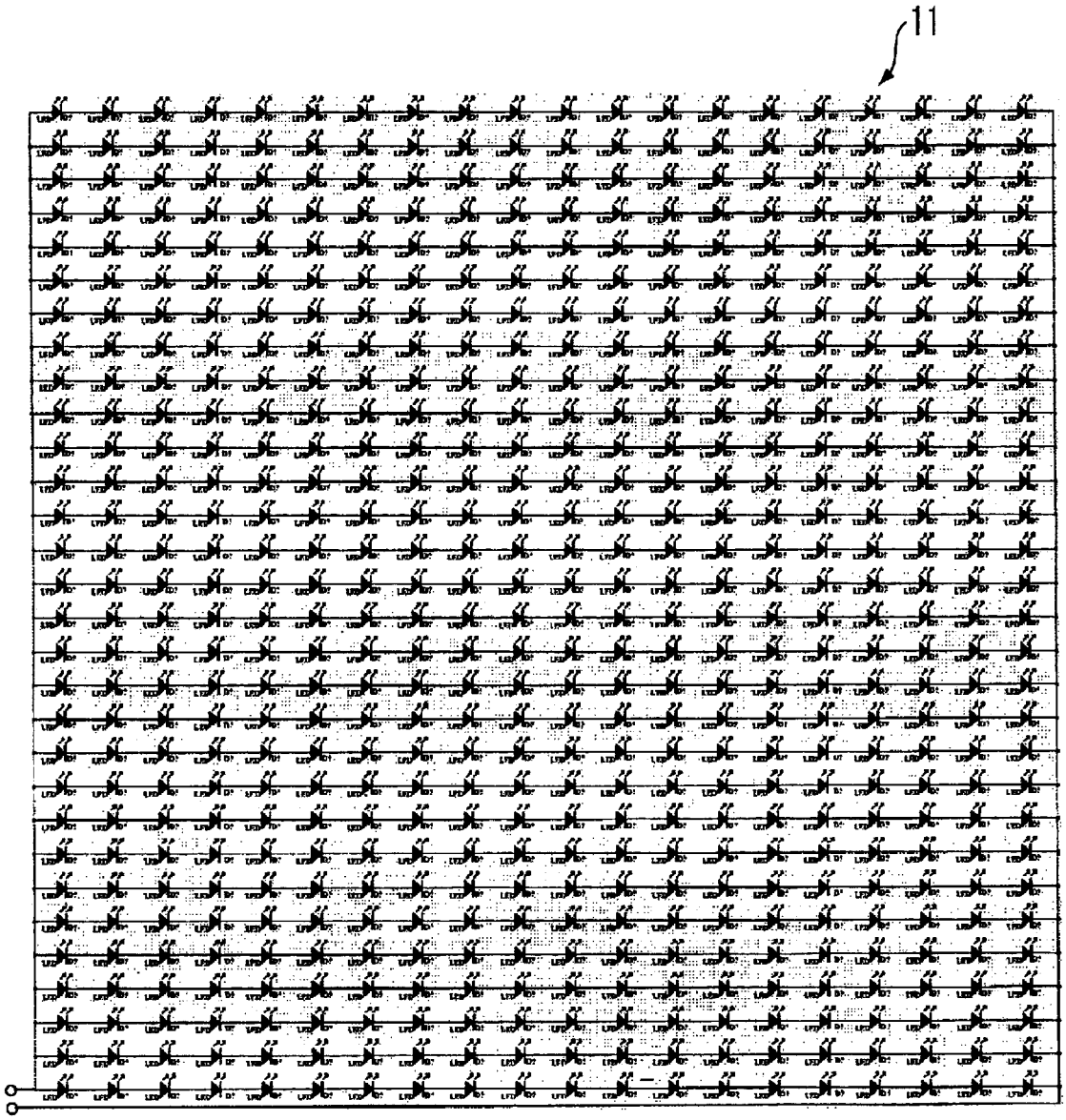
FIG. 3 is a circuit diagram showing an example of an LED array.

FIG. 2 is a circuit diagram showing an LED driving circuit according to a first embodiment of the present invention, and FIG. 3 is a circuit diagram showing an example of an LED array, which is an object driven by the LED driving circuit.

The LED driving circuit shown in FIG. 2 supplies an electrical current to flow through the LED array 11 shown in FIG. 3, which comprises series-parallel-connected LED devices, so that all LED devices turn on and off together. The LED array 11 is a two-terminal circuit, in which, for example, 30 lines of 20 pieces/line serially connected LED devices are connected in parallel, and total 600 pieces LED devices are turned on and off all together. The 600 pieces LED devices are disposed like a matrix on a surface of a substrate and comprises a surface light source. In FIG. 2, only one line of serially connected LED devices is described from parallel-serial-connected LED array in FIG. 3.

In FIG. 3, assuming that number of LED devices in a serially connected LED circuit is "n", and number of parallel-connected lines is "m", "n" and "m" of the LED array can be formed with arbitral natural number of 1, 2, 3, 4, . . . . It is not shown in FIG. 3, however, it is preferable to insert a resistor device at each line of serially connected LED circuit. According to the resistor device, even if variance of LED forward voltage Vf in the serially connected LED circuit exists, almost equal electrical current can be supplied at each of serially connected LED circuits and uniformity of brightness can be secured on all over the surface as a surface light source.

The LED array 11 is serially connected with the DC power supply 12 and the switching device (transistor) 13. When the switching device 13 turns on, almost equal electrical current flows through at each of serially connected LED circuits and all of LED devices in the array turns on to lighting state, and when the switching device 13 turns off, the electrical current is shut off and all of LED devices in the array turns off to lighting-out state. The control circuit 14 receives an input signal such as brightness signal and supplies on-signal voltage and off-signal voltage to the base terminal of the switching device 13. Therefore, it must be necessary that the power supply voltage Vcc of the DC power supply 12 must be more than a sum voltage of LED light-on forward voltages of n pieces at each line (forward voltage Vf×n pieces) and an on-voltage of the switching device 13.

Here, assuming that resistance value of a current setting resistor device 16, which is connected with emitter of the switching device 13, is R, emitter current Ie of the switching device 13 is calculated by following equation from nature of electric circuit, $$Ie=(V_{BON}-V_{BE})/R \text{ Provided,}$$

$V_{BON}$=on-signal voltage $V_{BE}$=voltage between base and emitter of the switching device $V_{BE}$ is a proper value of the switching device, and about 0.7-1.0 V in bipolar transistor case, and the resistance value R assumes to be a fixed value since it is a circuit constant value, emitter current (nearly equal to collector current) can be controlled by the on-signal voltage $V_{BON}$.

According to the LED driving circuit of the present invention, an additional circuit device 15 is connected in parallel with the switching device 13. The additional circuit device 15 is, for example, a high resistance resistor device. When the switching device 13 is turned off, the circuit device 15 makes a minute current flow through the serially connected LED circuit 11 to the extent that the LED devices are not turned on. Since the minute current flows through the serially connected LED circuit 11, the minute current generates forward voltage drop at each LED of serially connected LED devices and reduces voltage, which is applied to the switching device 13. That is, by the circuit device 15 connected in parallel with the switching device 13 at an output stage of the LED driving circuit, when the switching device 13 is turned off, the serially connected LED circuit 11 and the circuit device 15 are serially connected, and very small electrical current I flows through the serially connected LED circuit 11 and the circuit device 15. Therefore, since always "very small electrical current I>0", and forward voltage V of each LED device of serially connected LED circuit 11 becomes always "voltage drop V>0", and applied voltage Vsw to the switching device 13 can be reduced.

Figure 4:
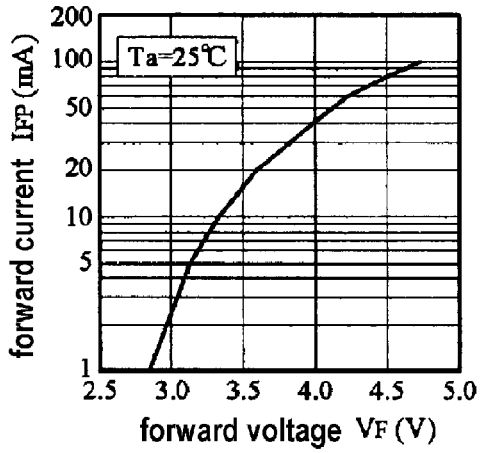
FIG. 4 is a view showing a forward voltage—an electrical current characteristics of a blue color LED.

As shown in FIG. 4, (cited from a catalog of Nichia Chemical Industry Co., Ltd.), forward voltage and forward current characteristics of a blue-color LED is such that forward voltage of 2.8 V at forward current of 1 mA is obtained and by flowing μA level current through the serially connected LED circuit, forward voltage of 2 volts can be obtained at each stage of serially connected LED devices.

According to an experiment by inventors and the like of the present invention, in a case that 20 pieces of blue-color LED devices are serially connected, a 470 kΩ resistor device is used as the additional circuit device 15, and power supply voltage Vcc is set to 84 V, when the switching device 13 is turned off, a result that 36V of applied voltage Vsw to the switching device 13 has been obtained. From the above result, assuming that leakage current of the switching device 13 is zero (for reference, according to product catalogue, leakage current must be less than 0.1 μA), it is understood that current I flowing through the circuit device 15 is about 76 μA, voltage between both terminals of the serially connected LED circuit 11 is 48V, and forward voltage drop at each stage of the serially connected LED circuit is about 2.4V.

Further, when the switching device 13 is turned on and rated current flows, applied voltage Vsw to the switching device 13 is 14V. From above result, forward voltage drop at each stage of serially connected LED circuit 11, when LED devices are on, is 3.5V and coincided with typical value of forward voltage Vf of product catalogue data.

Accordingly, when the circuit device 15 is not connected, applicable maximum voltage Vceo of the switching device 13 is required to be more than power supply voltage Vcc (more than 84V). However, by connecting the circuit device 15 of 470 kΩ resistor device, it was experimentally confirmed that applicable maximum voltage Vceo of the switching device 13 can be reduced to 36V, which is far lower than the power supply voltage Vcc. Further, resistance value of the circuit device 15 shall be determined so that LED does not turn on by the current flowing through the additionally parallel-connected circuit device 15. The current flowing through the circuit device 15 shall be as large as possible to the extent that LED devices are not turned on, then forward voltage drop along the serially connected LED circuit 11 becomes as large as possible, and then as lower as possible applicable maximum voltage Vceo switching device 13 can be adopted.

Therefore, according to the LED driving circuit of the present invention, by connecting circuit device 15 in parallel with the switching device 13, the applicable maximum voltage Vceo of the switching device 13 can be reduced. Then, the power supply voltage Vcc, which is higher than applicable maximum voltage Vceo of the switching device 13, can be used to the LED driving circuit, and then more LED devices than conventional technology can be further serially connectable and can be lighted on with all together. Further, in case that the number of serially connected LED devices is same with the conventional technology, the switching device, which has lower applicable maximum voltage Vceo, can be adopted, and then it makes possible to expand a choice chance of the switching device, and cost reduction and circuit performance improvement of the LED driving circuit can be expected.

As to an example of the circuit device 15, it is not limited to a resistor device. A device, which can supply a minute current flowing through the serially connected LED devices, can be used as the circuit device 15. For example, a constant voltage diode (Zener diode) can be used as the circuit device 15. According to above experiment, by using a Zener diode, which has 36V yield voltage, applied voltage Vsw to the switching device 13 is not increased more than 36V, and applicable maximum voltage Vceo of the switching device 13 can be reduced more than 36V.

Figure 5:
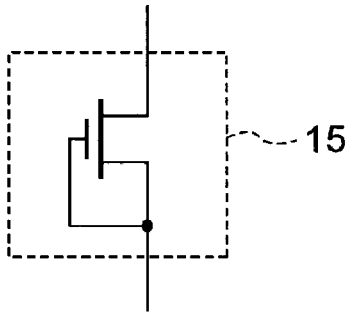
FIG. 5 is a view showing an example of a constant current diode device.
Figure 6:
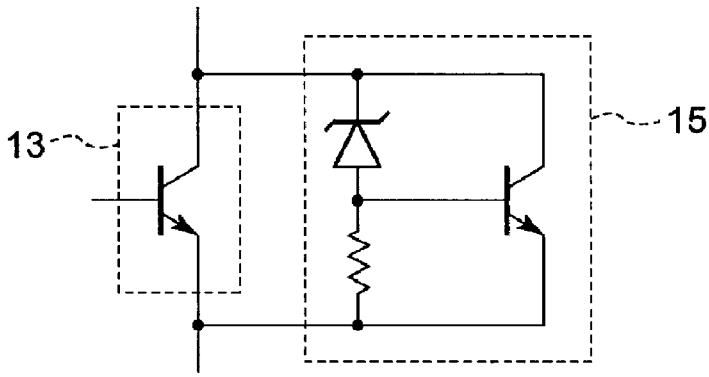
FIG. 6 is a view showing an example of a voltage limiting circuit.

Similarly, as to the circuit device 15, a constant current diode device, which is shown in FIG. 5, can be used. The constant current characteristics can be obtained by short circuit of a FET between source and gate electrodes. Also, voltage limiting circuit, which is shown in FIG. 6, can be used. This circuit comprises a constant voltage diode device and a transistor, wherein the Zener diode yields at a voltage, then the transistor becomes on-state, and then the transistor absorbs the current. According to the voltage limiting circuit, with having constant voltage diode characteristics, large current capacity comparing to the Zener diode can be obtained, and the circuit is suitable for large capacity LED array driving circuit and the like.

In above embodiments, examples, which use bipolar transistors as the switching device 13, are explained. However, other kinds of switching devices such as MOSFET and the like, may be used.

Next, the second embodiment of the LED driving circuit according to the present invention will be described below. The conventional LED driving circuit, which is shown in FIG. 1, supplies a constant voltage to the base terminal of the switching device 13, and when the transistor becomes on, almost constant current flows through the transistor, wherein the constant current is determined by a DC power supply 12, a serially connected LED circuit 11, and a current setting resistor 16 (constant current circuit). Therefore, it is difficult to control brightness of the panel widely, for example, from dim state to full lighting state.

Thus, the purpose of the second LED driving circuit of the present invention is to provide an LED driving circuit, which can control electrical current range widely from small current to large current, and which also can control fine adjustment of the electrical current.

Figure 7:
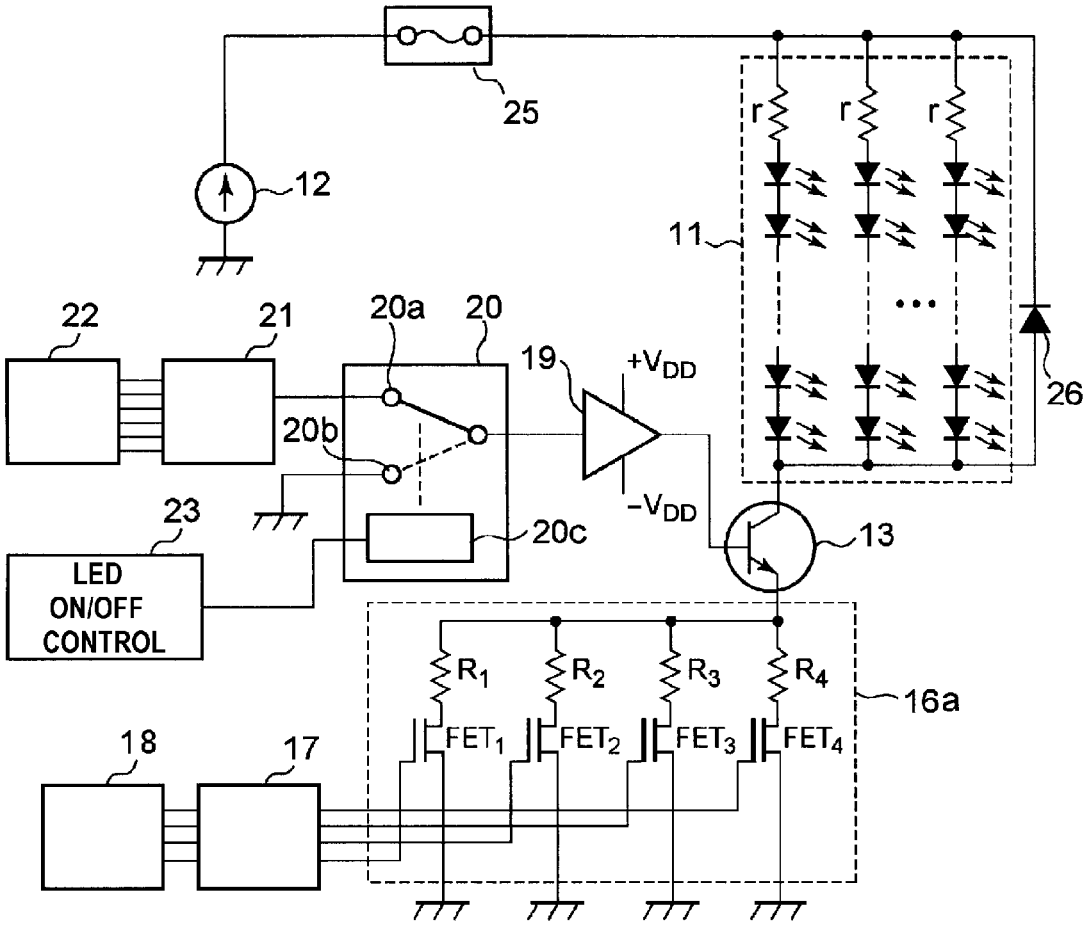
FIG. 7 is a circuit diagram showing an LED driving circuit according to a second embodiment of the present invention.

FIG. 7 shows a second embodiment of the LED driving circuit according to the present invention. The LED driving circuit comprises a DC power supply 12; a serially connected LED circuit 11, in which many LED devices are serially connected; a transistor 13 for controlling electrical current flowing through the serially connected LED circuit 11; a current setting resistor circuit 16*a* comprising a plural of resistors ($R_1$,$R_2$,$R_3$,$R_4$) connected in parallel with each other, the resistors are connected between first switching device 13 and ground terminal, and second switching devices ($FET_1$, $FET_2$,$FET_3$,$FET_4$) which are serially connected with the resistors ($R_1$,$R_2$,$R_3$,$R_4$) respectively; and a setting circuit 17 for setting on and off of the second switching device respectively.

The serially connected LED circuit 11 for being driven is the LED array (see FIG. 3), which was described in the first embodiment of the present invention.

The current setting resistor circuit 16*a* comprises a plural of resistors $R_1$, $R_2$, $R_3$, $R_4$ connected in parallel with each other and second switching devices $FET_1$, $FET_2$, $FET_3$, $FET_4$ which are serially connected to the resistors $R_1$, $R_2$, $R_3$, $R_4$ respectively. Gate terminals of the switching devices $FET_1$, $FET_2$, $FET_3$, $FET_4$ are respectively connected to outputs of the FET setting control circuit 17, and inputs of the FET setting control circuit 17 are connected to current range setting circuit 18. Accordingly, by current range setting circuit 18, on or off of the switching devices $FET_1$, $FET_2$, $FET_3$, $FET_4$ are respectively set, on-voltages or off-voltages are respectively supplied to the gate terminals of the switching devices $FET_1$, $FET_2$, $FET_3$, $FET_4$ from the FET setting control circuit 17, each of switching devices becomes on-state or off-state, and conductions or non-conductions of the resistors $R_1$, $R_2$, $R_3$, $R_4$ are respectively set.

For example, if $R_1=R_2=R_3=R_4=R_0$, synthetic resistance R of the current setting resistor circuit 16*a* can be changed into following four steps;

when any one of switching devices $FET_1$, $FET_2$, $FET_3$, and $FET_4$ becomes on-state, then $R=R_0$;

when any two of switching devices $FET_1$, $FET_2$, $FET_3$, and $FET_4$ becomes on-state, then $R=R_0/2$;

when any three of switching devices $FET_1$, $FET_2$, $FET_3$, and $FET_4$ becomes on-state, then $R=R_0/3$; and when all four of switching devices $FET_1$, $FET_2$, $FET_3$, and $FET_4$ becomes on-state, then $R=R_0/4$.

For example, if $R_0=R_1=2\ R_2=4R_3=8R_4$, synthetic resistance R of the current setting resistor circuit 16*a* can be changed into 15 steps by combination of the $4^{th}$ power of 2 according to combination of on-state(s) of switching devices $FET_1$, $FET_2$, $FET_3$, and $FET_4$. Further, the combination of the $4^{th}$ power of 2 becomes 16 steps. However, a case should be excluded that all of switching devices are off-state, and then possible combination becomes 15 steps.

Next, a driving circuit of the transistor 13 will be described. An output of the buffer amplifier 19 is connected to the base terminal of the transistor 13, the buffer amplifier is supplied with power supply $+V_{DD}$ and $-V_{DD}$, and analog voltage output of the buffer amplifier can be available in the extent between $+V_{DD}$ and $-V_{DD}$. An output of the multiplexer 20 is connected to the input of the buffer amplifier 19, and the multiplexer 20 outputs selected input signal of input terminal 20*a* and input terminal 20*b* by control of the controller 20*c*.

An 8 bit brightness setting circuit 22 and an 8 bit D/A converter 21 is connected to the input terminal 20*a* of the multiplexer 20. Accordingly, by a combination of the 8 bit digital signal of the brightness setting circuit 22, the 256 steps of analog voltage can be outputted from the D/A converter 21. To another input terminal 20*b*, earth potential (ground voltage) is connected. In this embodiment, earth potential is connected to the input terminal 20*b*, however, negative voltage can be connected to the input terminal 20*b* for high speed switching of the transistor 13.

An LED on/off setting circuit 23 is connected to controller 20*c* for controlling timings of LED devices on (lighting) and LED devices off (lighting-out). That is; when an on-signal is outputted from the controller 21*c*, the output of the multiplexer 20 is switched to the input terminal 20*a*, an output analog voltage, which is outputted from the D/A converter 21, is supplied to the base terminal of the transistor 13 via the buffer amplifier 19, and an electrical current corresponding to the base voltage flows through the serially connected LED circuit 11. When an off-signal is outputted from the controller 21*c*, the output of the multiplexer 20 is switched to the input terminal 20*b*, a ground voltage is supplied to the base terminal of the transistor 13 via the buffer amplifier 19, and the transistor 13 becomes off-state and an electrical current flowing through the serially connected LED circuit 11 is shut off.

The controller 20*c* outputs LED on-signals and off-signals with the timing set by the LED on/off setting circuit 23. For example, when a cycle-time and a duty-ratio is set at the on/off setting circuit 23, corresponding on-time and off-time of the LED devices are outputted to the controller 20*c*, input terminals 20*a* and 20*b* are switched and LED on-state (lighting) and LED off-state (lighting-out) are switched.

Figure 8:
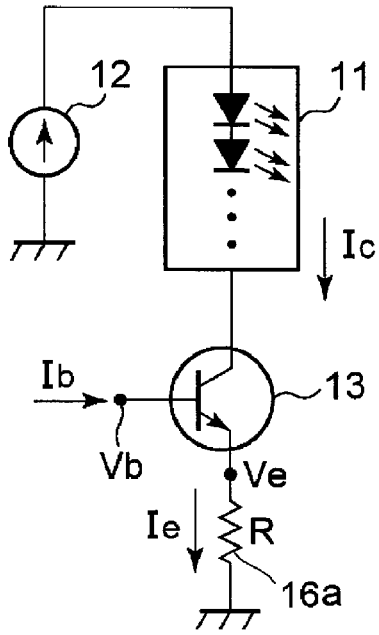
FIG. 8 is an equivalent circuit diagram showing a current setting resistor device, a first switching device and their peripherals.

Next, an operation of the current setting resistor circuit 16*a* will be described. FIG. 8 is an equivalent circuit diagram upon transistor 13 and its peripherals when synthetic resistance of the current setting resistor circuit 16*a* is R. The base voltage Vb, the emitter voltage Ve, the collector current Ic, the emitter current Ie, and the base current Ib of the transistor 13 are related with each other as shown in equation (1)-(3).

$$Vb=Vbe+R\times Ie \tag{1}$$

provided, Vbe is a transistor between base/emitter voltage.

$$Ie=Ib+Ic \tag{2}$$

$$Ic=h_{FE}\times Ib \tag{3}$$

provided, $h_{FE}$ is a current amplifying ratio of the transistor.

Accordingly by equation (1), $$Ie=(Vb-Vbe)/R \tag{4}$$

According to equation (2) (3), $$Ie=(1/h_{FE}+1)\times Ic \quad (5)$$

provided, for example, $h_{FE}$ of a transistor (2 SC5610) is 150-300, then $(1/h_{FE}+1)$ is nearly equal to 1, and then;

$$Ie\approx Ic \quad (6)$$

Accordingly, $$Ic\approx(Vb-Vbe)/R \quad (7)$$

For example, upon a transistor (2SC5610), assuming that Vbe is 0.7-1.0 V, Vb is fine-adjustable in the extent of 0-4.5 V, and (Vb−Vbe) is constant, the collector current Ic becomes almost inverse-proportional to synthetic resistance R. For example, assuming that (Vb−Vbe) is adjusted to be 3V and synthetic resistance R is 1Ω, the collector current Ic becomes 3 A. Assuming that synthetic resistance R is 10Ω, the collector current Ic becomes 0.3 A, and assuming that synthetic resistance R is 100Ω, the collector current Ic becomes 0.03 A, and then switching of current ranges of constant current circuit can be possible.

Therefore, according to combinations of on and off of $FET_1$, $FET_2$, $FET_3$, and $FET_4$ in the current setting resistor circuit 16*a*, synthetic resistance R can be set to $R=R_0$, $R=R_0/2$, $R=R_0/3$, and $R=R_0/4$. Then in the case that the collector current $Ic=I_0$, when $R=R_0$, the collector current Ic can be switched to $I_0$, $2I_0$, $3°\ I_0$, and $4I_0$.

For example, in a case of $R_0=R_1=2R_2=4R_3=8R_4$, synthetic resistance R of the current setting resistor circuit 16*a* can be switched into $2^4$-1 steps, that is 15 steps, by combination of on-state(s) of switching devices $FET_1$, $FET_2$, $FET_3$, and $FET_4$. That is; collector current Ic can be switched into 15 steps of multiple integer number of $I_0$, such as $I_0$, $2\ I_0$, $3\ I_0$, $4\ I_0$, $5\ I_0$, $6\ I_0$, $7\ I_0$, $8\ I_0$, . . . , $15\ I_0$. Therefore, the current flowing through the serially connected LED circuit 16 (collector current Ic) can be switched into multiple integer numbers of 4 steps or 15 steps with equal interval and the current can be roughly switched in wide current range.

The base voltage Vb can be adjustable as follows. That is; an 8 bit brightness setting circuit 22 and an 8 bit D/A converter 21 is connected to an input terminal 20*a* of the multiplexer 20, and by a combination of 8 bit digital signals of the brightness setting circuit 22, an output of analog voltage of 256 steps is supplied from the D/A converter 21 to the base terminal of the transistor 13 via the buffer amplifier 19. Accordingly as to this embodiment, by the 8 bit brightness setting circuit 22 and the 8 bit D/A converter 21, the base voltage Vb can be set into 256 steps with equal interval in a range between almost power supply voltage of $+V_{DD}$ and $-V_{DD}$ of the buffer amplifier 19.

For an example, since base voltage Vb can be fine-adjustable in extent of 0-4.5V, accordingly current flowing through the serially connected LED circuit 11 (collector current Ic) can be fine-adjustable according to equation (7). Therefore, upon the LED driving circuit, with rough control of an electrical current (collector current Ic) by resistor switching according to the current setting resistor circuit 16*a*, which is connected between the emitter of the transistor 13 and the ground terminal, fine control of an electrical current (collector current Ic) can be possible in extent of wide current ranges.

Next, an improvement of control accuracy of electrical current (collector current Ic) by resistor switching of the current setting resistor circuit 16*a* will be described.

In case that conventional resistance-constant current setting resistor 16 is connected between emitter terminal of the switching device 13 and ground terminal, if collector current Ic is set to be large, resistance of the resistor must be set to be small. When the resistance is set to be small, and in a case that the collector current Ic is set to be small, there is a problem that control accuracy of collector current Ic becomes worse, because of, for example, temperature drift of transistor 13. In other word, there has been a problem that wide range control of collector current Ic is incompatible with high accuracy control of the electrical current.

As mentioned above, the collector current Ic is, according to equation (7).

$$Ic\approx(Vb-Vbe)/R$$

Here, it is assumed that transistor between base/emitter voltage Vbe is changed by ΔVbe, for example, by temperature drift and the like. Solving a change of collector current ΔIc basing on change of transistor between base/emitter voltage Vbe, ΔVbe can be calculated as follows from above equation;

$$\Delta Ic/\Delta Vbe\approx 1/R \quad (8)$$

Accordingly, the change of collector current ΔIc/Ic basing on change of base/emitter voltage ΔVbe can be calculated as follows from equation (8)

$$\Delta Ic/Ic\approx(-1/R)\times\Delta Vbe/Ic \quad (9)$$

Therefore, assuming that resistance R is constant and change of base/emitter voltage ΔVbe is constant, change of collector current ΔIc/Ic basing on change of base/emitter voltage ΔVbe is 5 times higher when collector current Ic=1 A comparing with collector current Ic=5 A.

However, according to current setting resistor circuit 16*a* of the present invention, collector current Ic has following relation from equation (7);

$$Ic\approx(Vb-Vbe)/R$$

Accordingly, when synthetic resistance R is set to be, for example, 1Ω, collector current becomes 5 A, and assuming that Ve=(Vb−Vbe) is constant, and synthetic resistance R is set to be, for example, 5Ω, collector current Ic becomes 1 A.

Thus, by setting synthetic resistance R to be 1Ω, when collector current Ic is 5 A, and by setting synthetic resistance R to be 5Ω, when collector current is 1 A, then ΔIc/Ic does not change from equation (9). That is, for example, in case of collector current Ic=5 A changing from collector current Ic=1 A, according to conventional technology, change ratio of collector current (ΔIc/Ic) against change of ΔVbe changes 5 times higher, however, by changing synthetic resistance R to be 5 times higher, change ratio of collector current (ΔIc/Ic) against change of ΔVbe does not change according to the present invention, and it can improve to ⅕ reduction comparing to conventional technology according to the present invention. In other word, wide range control of collector current Ic and high accuracy control of the current can go together.

Next, a fuse 25 in FIG. 7 will be described. In the LED driving circuit, a fuse 25 is provided at a current path flowing through the serially connected LED circuit 11. Generally speaking, in case of pulse-lighting, large electrical current capacity can be obtained comparing to DC-lighting. However, in case of failure of the LED driving circuit, it is possible that large DC current flows through the serially connected LED circuit 11 and exceeds the current capacity of the circuit elements, and makes the circuit elements damaged and destroyed. In the LED driving circuit, since an electrical current (collector current Ic) can be roughly adjusted in wide current range, by connecting the fuse 25, the above mentioned problem can be solved, and circuit elements such as the serially connected LED circuit 11 and the transistor 13 are prevented from damaged and destroyed.

Figure 9A:
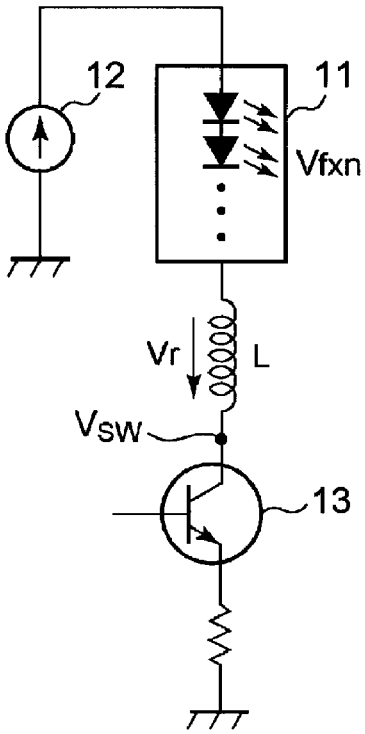
FIG. 9A is an equivalent circuit diagram showing a conventional LED driving circuit.

Next, a diode 26 in FIG. 7 will be described. In the LED driving circuit, a diode 26 is connected in parallel with the serially connected LED circuit 11. Generally speaking, stray inductance is existing in wirings, especially as to serially connected LED circuit 11, which comprises many LED devices serially connected on a panel, wiring length of the circuit 11 becomes especially long, and large stray inductance is existing. Therefore, equivalent circuit diagram is shown in FIG. 9A. Assuming that equivalent stray inductance of the serially connected LED circuit 11 is L, back electromotive voltage Vr is generated when LED devices are switched from lighting state to lighting-out state.

$$Vr=L\times(\Delta Ic/\Delta t) \quad (10)$$

The back electromotive voltage Vr becomes large at high-speed switching, and voltage Vsw, which is applied to collector of the transistor 13, is shown as follows.

$$Vsw=Vcc+Vr-Vf\times n \quad (11)$$

provided, Vcc: power supply voltage, Vf: LED forward voltage, n: number of steps of serially connected LED devices.

Here, if the voltage Vsw, which is applied to collector of the transistor 13, exceeds collector/emitter absolute maximum rated voltage $V_{CEO}$ of the transistor 13, the transistor 13 will be damaged and destroyed.

For example, assuming that collector current Ic is 0.5 A, off time of the transistor 13 is 5 nS, and collector current Ic changes linearly, $$\Delta Ic/\Delta t=0.5/(5\times10^{-9})=1\times10^{8}(A/s)$$

$$Vr=L\times1\times10^{8}$$

For example, LED Vf=3.6V, number of steps of LED devices n=10, Vcc=50V, $L=5\times10^{-7}$ (H)=0.5 (μH), then, $$Vr=50(V)$$

From equation (9), $$Vsw=64(V)$$

Then, as to collector/emitter absolute maximum rated voltage $V_{CEO}$, $V_{CEO}>64$ (V) is required.

Figure 9B:
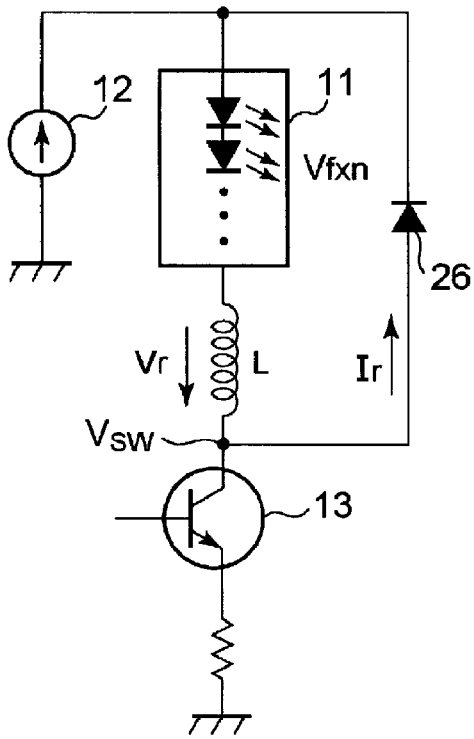
FIG. 9B is an equivalent circuit diagram showing an LED driving circuit according to the second embodiment of the present invention, which provides with a diode device.

Therefore, according to conventional LED driving circuit shown in FIG. 9A, back electromotive voltage Vr is generated by stray inductance L of the serially connected LED circuit 11, when the electrical current is cut off. The back electromotive voltage Vr becomes larger when wiring length of the serially connected LED circuit becomes longer and inductance L becomes larger, or off time (Δt) becomes shorter. So, it is possible to damage and destroy the transistor 13. As shown in FIG. 9B, by connecting a diode 26 in parallel with the serially connected LED circuit 11, even if back electromotive voltage Vr generates, the voltage Vr can be released as circulating current flowing through the diode 26. Then the back electromotive voltage Vr does not be applied to transistor 13 between collector and emitter. Accordingly, as to collector/emitter absolute maximum rated voltage $V_{CEO}$ of the transistor 13 it is not necessary to consider effects of the back electromotive voltage Vr when current shut off, and the $V_{CEO}$ of the transistor 13 is enough if it is over the power supply voltage Vcc. Then transistors having relatively low collector/emitter absolute maximum rated voltage $V_{CEO}$ can be used.

According to above, even if making LED steps of serially connected LED circuit 11 large, and making the LED circuit 11 large, and making current off time shorter and faster when lighting-out, back electromotive voltage Vr caused by stray inductance L does not effect to transistor 13. Then, longer and larger serially connected LED circuit 11 and its high-speed lighting and lighting-out can be promoted with safety.

Next, third embodiment of the LED driving circuit of the present invention will be described.

According to conventional LED driving circuit shown in FIG. 1, there is a problem that it is difficult to control high speed lighting and lighting-out by using narrow width current pulse, such as units of 10 nS, since many LED devices are serially connected and wiring length becomes so long, and stray inductance and stray capacitance are so large.

Figure 10:
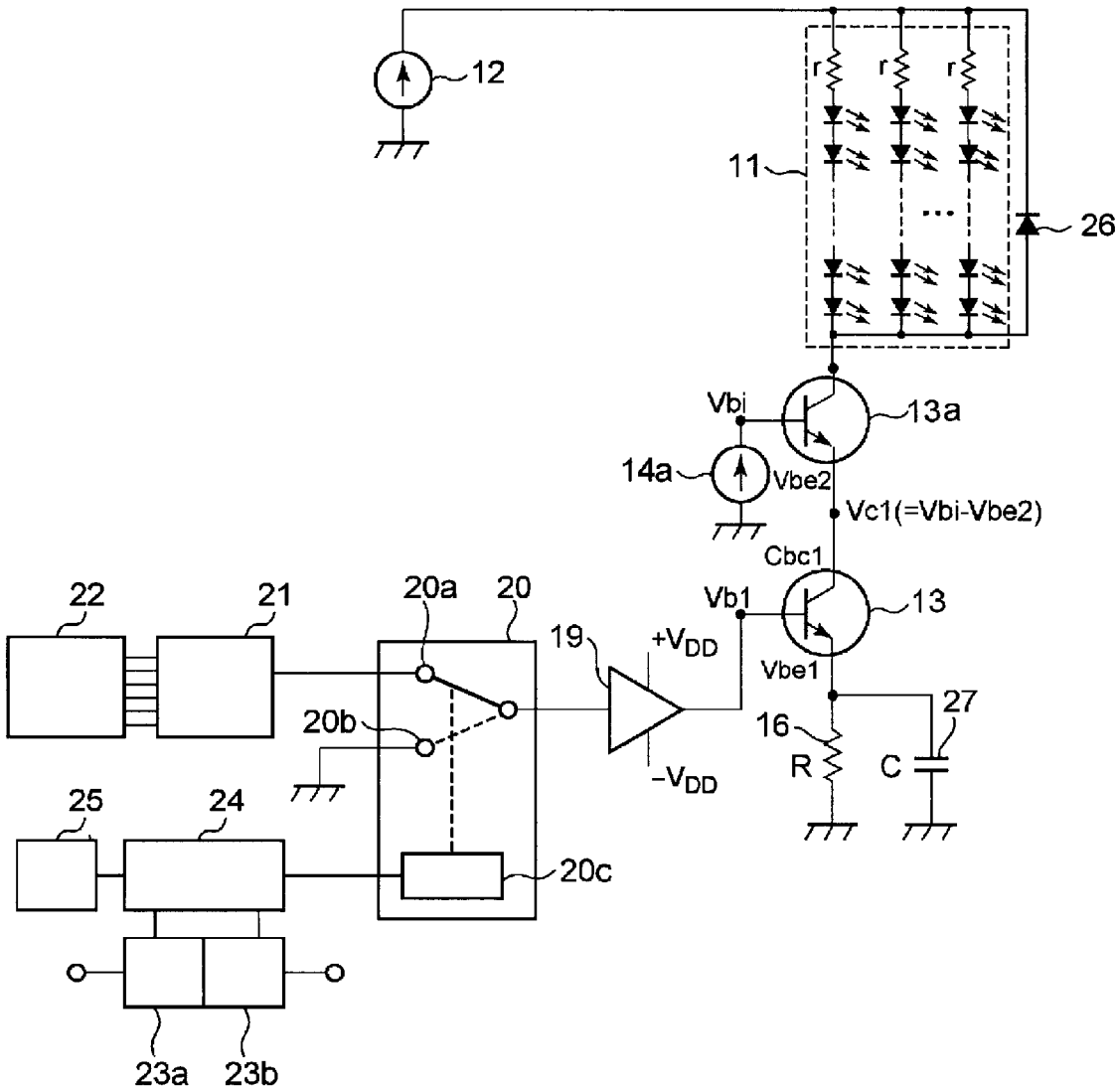
FIG. 10 is a circuit diagram showing an LED driving circuit according to a third embodiment of the present invention.

Therefore, it is an object of this embodiment to provide an LED driving circuit, which can control high speed lighting and lighting-out by using narrow width current pulse, such as units of 10 nS, and can supply high accuracy current flowing through the serially connected LED circuit. FIG. 10 shows a structural example of the LED driving circuit according to third embodiment of the present invention.

The LED driving circuit comprises a DC power supply 12; a serially connected LED circuit 11 in which many LED devices are serially connected; a first transistor 13, which controls current flowing through the serially connected LED circuit 11; a transistor 13*a*, which is connected between the serially connected LED circuit 11 and the first transistor 13, and is cascade-connected with the first transistor 13; a current setting resistor 16, which is connected between emitter of the first transistor 13 and ground terminal (GND); a buffer amplifier 19, which is connected with base terminal of the first transistor 13; a multiplexer 20, which is connected with input terminal of the buffer amplifier for switching LED on-signal and off-signal; and a lighting time control circuit 24 for forming times of LED on-signal and off-signal.

The serially connected LED circuit 11, which is to be driven, is the LED array (see FIG. 3), which was described in the first embodiment.

Next, a driving circuit for the transistor 13 will be described. An output of wide band buffer amplifier 19, which has band width of about 350 MHz, is connected to base terminal of the transistor 13. The buffer amplifier 19 is supplied with $+V_{DD}$ and $-V_{DD}$ power source voltages, and is available for outputting analog voltage almost in this voltage range. An output of high-speed multiplexer 20, which has 250 MHz band-width and in which switching of 10 nS pulse-width is possible, is connected to an input of the buffer amplifier 19. The multiplexer 20 outputs LED on (lighting) signal of input terminal 20*a* and LED off (lighting-out) signal of input terminal 20*b*, which are switched by control of the controller 20*c*.

An 8 bit brightness setting circuit 22 and an 8 bit D/A converter 21 is connected to input terminal 20*a* of the multiplexer 20. Therefore, by a combination of 8 bit digital signal of the brightness setting circuit 22, the D/A converter 21 can output analog voltage of 256 steps. The other input terminal 20*b* of the multiplexer 20 is connected to ground terminal, and ground (GND) voltage is outputted. Further, negative voltage can be connected to the input terminal 20*b*, and by pulling out current from the base terminal of the transistor 13, faster lighting-out operation can be possible.

A counter (lighting time control circuit) 24 is connected to the controller 20*c* for controlling on (lighting) time and off (lighting-out) time of the serially connected LED circuit 11. That is, when the controller 20*c* outputs on-signal, output of the multiplexer 20 is switched to input terminal 20*a*, then analog voltage, which is outputted from the D/A converter 21, is supplied to the base terminal of the transistor 13 via the buffer amplifier 19, and then an electrical current corresponding to the base voltage flow through the serially connected LED circuit 11 during a period of on-signal. When the controller 20*c* outputs off-signal, output of the multiplexer 20 is switched to input terminal 20*b*, then GND voltage is supplied to the base terminal of the transistor 13 via the buffer amplifier 19, and then the transistor 13 becomes off-state, and electrical current flowing through the serially connected LED circuit 11 is shut off during a period of off-signal.

That is, a cycle time and a duty ratio of LED lighting are set at on/off time setting circuit 23*a*, 23*b*, pulses, for example, of unit time of 10 nS, from clock source 25, are counted by counter 24, and then variable width pulse of on-time and off-time, which are set at on/off time setting circuit 23*a*, 23*b*, is formed and outputted to the controller 20*c*. Therefore, the controller 20*c* switches input terminals of the multiplexer 20 by the timing, which is set at on/off time setting circuit 23*a*, 23*b*, and outputs LED on-signal and off-signal.

Therefore, LED on-time and off-time can be set in range of 0-48 H at integer times (N times) of 10 nS, and period of lighting and lighting-out can be set in range of 20 nS-48 H at integer times of 10 nS. Accordingly, duty ratio, which is ratio of period of lighting and lighting-out to period of lighting, can be adjustable, and for example, period of lighting and lighting-out and duty ratio can be set at integer times of 10 nS. However, integer times N should be in extent of about $0\text{-}2^{48}$.

The LED driving circuit is provided with transistor 13*a*, which is cascade-connected with the first transistor 13 between the serially connected LED circuit 11 and the first transistor 13 as shown in FIG. 10.

Figure 11A:
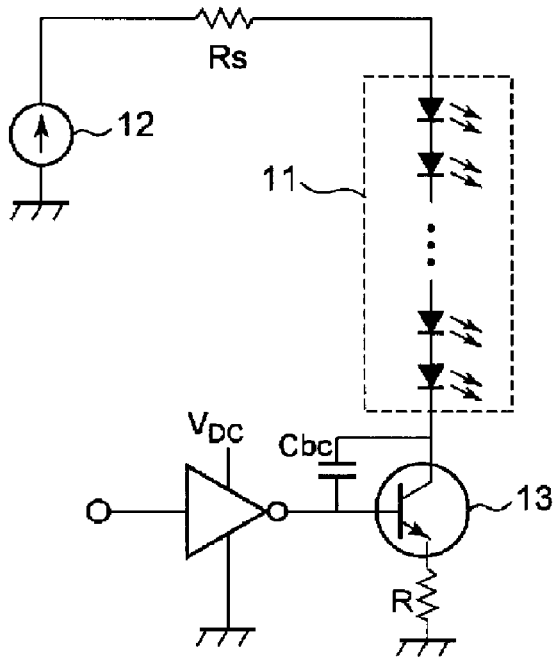
FIGS. 11A through 11C are equivalent circuit diagrams showing operations of cascade-connected transistors.
Figure 11B:
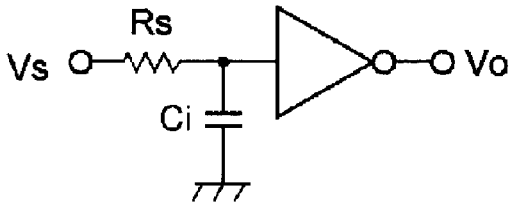

As shown in FIG. 11*a*, according to conventional circuit structure, there is a problem that mirror effect occurs by stray capacitance Cbc of the transistor 13 between collector and base, cut off frequency becomes lower in frequency characteristics of the circuit, and switching speed is reduced. That is, an equivalent circuit diagram of conventional emitter-grounded transistor amplifying circuit is shown in FIG. 11B. Therefore, input capacitance Ci in appearance of the transistor 13 is, $$Ci=Cbc1\times(1+Av)$$

provided, Cbc1: capacitance between base and collector of transistor 13,

Av: voltage gain of transistor 13

Accordingly, voltage gain A1 of equivalent amplifying circuit shown in FIG. 11B is, $$A1=Vo/Vs=Av/(1+2\pi f\times Ci\times Rs\times j)$$

provided, f: frequency, Rs: internal resistance of signal source, j: imaginary number.

However, according to the LED driving circuit of the present invention, there is provided a transistor 13*a*, which is cascade-connected with the first transistor 13, between the serially connected LED circuit 11 and the first transistor 13 as shown in FIG. 10. Therefore, since the transistor 13*a* is cascade-connected, collector voltage Vc1 of the transistor 13 becomes;

$$Vc1=Vbi-Vbe2$$

then, Vc1 is fixed to a constant value. Provided,

Vbi: base bias voltage of the transistor 13*a*,

Vbe2: voltage between base and emitter of the transistor 13*a*.

Figure 11C:
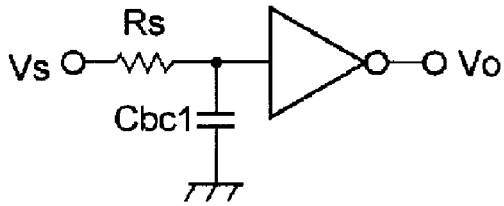

Since voltage between collector and base of the transistor 13 is;

$$Vc1-Vb1,$$

then, mirror effect does not occur. Therefore, at the base terminal, input capacitance in appearance becomes Cbc1, and then its equivalent circuit diagram becomes as shown in FIG. 11C.

Therefore, as to voltage gain A2 of the equivalent circuit diagram, $$A2=Vo/Vs=Av/(1+2\pi f\times Cbc1\times Rs\times j)\text{Provided,}$$

f: frequency, Rs: internal resistance in signal source, j: imaginary number.

As to cut off frequency, assuming that conventional case is fc1 and assuming that cascade-connected case is fc2, $$fc1=1/(2\pi\times Ci\times Rs)$$

$$fc2=1/(2\pi\times Cbc1\times Rs)$$

Therefore, calculating ratio of cut off frequency of present embodiment fc2 to cut off frequency of conventional technology fc1, $$fc2/fc1=Ci/Cbc1=1+A$$

Roughly by voltage gain A, the cut off frequency of present example is improved comparing to cut off frequency of conventional example. In other word, narrow width current pulse can be applied to the LED devices, and high speed lighting and lighting-out of the LED devices can be possible.

Operation of the current setting resistor 16 is the same as constant current control operation of synthetic resistance R of the current setting resistor circuit 16*a*, which was described in FIG. 8 and in the second embodiment of the present invention. In this embodiment, instead of single current setting resistor device 16, the current setting resistor circuit 16*a*, which comprises a plural of resistors and second switching devices respectively connected to each of the plural of resistors, can be adopted, and can be a resistance-variable synthetic resistance R. Therefore, the current flowing through the serially connected LED circuit 11 (collector current Ic) can be rough-adjustable at wide range. Accordingly, adjustment of the current range from small current to large current can be possible, and high speed lighting and lighting-out control with using narrow width current pulse, for example, unit time of 10 nS, can be possible.

Similarly, an 8 bit brightness setting circuit 22 and an 8 bit D/A converter 21 is connected to input terminal 20*a* of multiplexer 20, and by a combination of 8 bit digital signal of the brightness setting circuit 22, an output of analog voltage of 256 steps with same interval is outputted from D/A converter 21 to base terminal of transistor 13 via buffer amplifier 19. Accordingly, in this embodiment, base voltage Vb can be set at 256 steps with equal interval in extent of power source voltage between $+V_{DD}$ and $-V_{DD}$ of buffer amplifier 19 by the 8 bit brightness setting circuit 22 and the 8 bit D/A converter 21. Therefore, fine-adjustment of an electrical current flowing through the serially connected LED circuit 11 (collector current Ic) can be possible and the electrical current can be adjustable with high accuracy and in wide range.

Figure 12A:
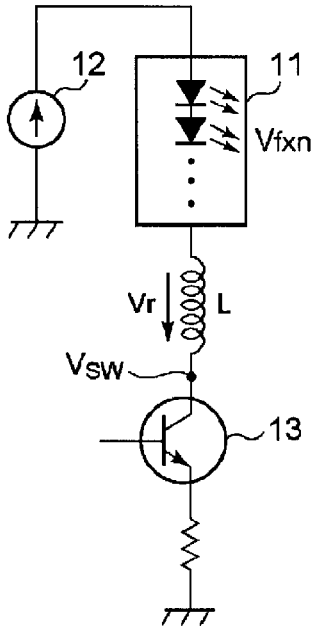
FIG. 12A is an equivalent circuit diagram showing a conventional LED driving circuit.

Next, a diode 26 in FIG. 10 will be described. In the LED driving circuit, a diode 26 is connected in parallel with the serially connected LED circuit 11. Generally speaking, stray inductance is existing in wirings. Since the serially connected LED circuit 11 is a circuit in which many LED devices are series-parallel connected, wiring length becomes so long and large stray inductance is existing. Thus, equivalent circuit diagram is shown in FIG. 12A. Assuming that equivalent stray inductance of the serially connected LED circuit 11 is L, back electromotive voltage Vr is generated when turning LED devices from lighting state to lighting-out state.

$$Vr=L\times(\Delta Ic/\Delta t)$$

The back electromotive voltage Vr becomes especially large at high-speed switching, voltage Vsw, which is applied to collector of transistor 13, becomes as follows.

$$Vsw=Vcc+Vr-Vf\times n \text{ Provided,}$$

Vcc: power source voltage, Vf: LED forward voltage, n: number of LED steps.

Thus, if voltage Vsw, which is applied to collector of transistor 13, exceeds over collector/emitter absolute maximum rated voltage $V_{CEO}$ of the transistor 13, the transistor 13 will be damaged and destroyed.

Figure 12B:
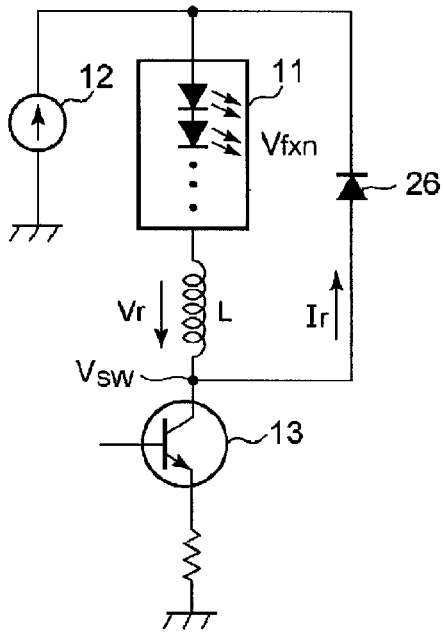
FIG. 12B is an equivalent circuit diagram showing an operation of a diode, which is connected in parallel with the serially connected LED circuit of the present invention.

As shown in FIG. 12B, since a diode 26 is connected in parallel with the serially connected LED circuit 11, even though the back electromotive voltage Vr is generated, it is possible to release as circulating electrical current flowing through the diode 26, and the back electromotive voltage Vr can not be applied between collector and emitter of the transistor 13. Further, by connecting the diode 26 in parallel with the serially connected LED circuit 11, the diode 26 forms a by-pass circuit for flowing through high frequency component of electrical current, and it contributes to make the LED driving circuit high-speed.

Next, a condenser 27 in FIG. 10 will be described. Generally speaking in wiring, stray capacitance is existing against GND and so on. Since the serially connected LED circuit 11 is a circuit, in which many LED devices are serially connected, its wiring length is so long and large stray capacitance is existing. Therefore, there is a problem that when switching device is turned on or off for lighting or lighting-out LED devices, time delay is generated for actually lighting or lighting-out of LED devices, and it is difficult to turn LED devices on or off rapidly (in short time). In other word, charging time for the stray capacitance becomes delay time.

Figure 13A:
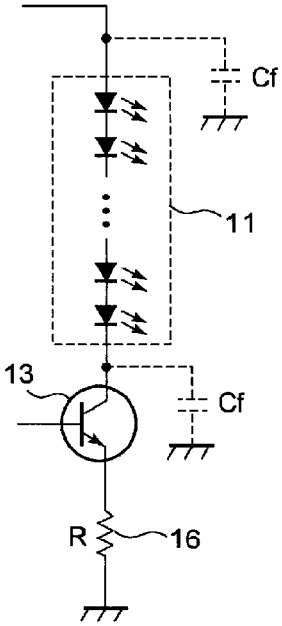
FIGS. 13A through 13C are equivalent circuit diagrams showing operations of a condenser, which is connected in parallel with the current setting resistor device.

An equivalent circuit diagram according to conventional example is shown in FIG. 13A. Assuming that stray capacitance is Cf, current flowing through LED devices (collector current Ic) is Ic, voltage variation of stray capacitance Cf when LED devices turning from lighting-out state to lighting state is ΔV, and neglecting current flowing through LED devices, $$T_{ON}=\Delta V\times Cf/Ic$$

that is, this becomes delay time. For example, assuming that ΔV=5V, Cf=1000 pF, Ic=10 mA, delay time $T_{ON}$ becomes $5\times10^{-7}$ (sec).

Figure 13B:
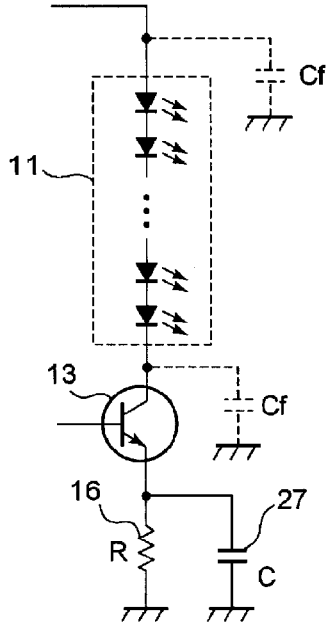
Figure 13C:
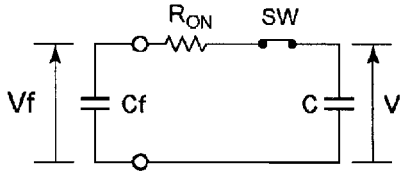

According to the LED driving circuit of the present invention, for shortening the delay time, there is provided a condenser 27 (capacitance C), which is connected in parallel with the current setting resistor 16. Equivalent circuit diagrams are shown in FIG. 13B and FIG. 13C. Transit response of turning LED devices from off to on is, such that from FIG. 13C, charges stored at stray capacitance Cf (initial voltage V1) flow into added condenser C via transistor 13 of on-state (on resistance Ron), and expressed by following equation.

$$Cf\times Vf=Cf\times V1\times(1+\exp(-t\times2/Ron/C))/2$$

For brief solution, assuming C=Cf, and neglecting current flowing through LED devices, $$Vf=V1\times(1+\exp(-t\times2/Ron/C))/2$$

solving the equation regarding to t (sec), $$t=Ron\times C\times\ln(V1/(2\times Vf-V1))/2$$

For example, assuming that Ron=100 mΩ, C=1000 pF, changed voltage of Cf ΔV=V1/3, and time transiting from lighting-out state to lighting state is Ton, then, $$Ton=5.5\times10^{-11}(\text{sec})$$

Therefore, by connecting condenser C in parallel with the current setting resistor device, about 9000 times faster switching can be possible.

While, when lighting-out LED devices, since condenser 27 is charged up, by applying low voltage (GND voltage and the like) to base of the transistor 13, voltage between both ends of the condenser 27 (Vc) becomes back bias voltage to the transistor 13, and it can transit the transistor 13 into off-state rapidly. Therefore, it can be possible to light-out LED devices in short time (rapidly).

In the embodiments described above, as to switching device, examples of using transistors are described. However, FET and other switching devices also may be used.

Also, first to third embodiments of the LED driving circuit according to the present invention has been described respectively, however it may be of course possible to combine these embodiments to form the LED driving circuit. Therefore, according to the present inventions, a high-performance LED driving circuit is produced, which can economically drive a serially connected LED circuit by a switching device with a relatively low withstanding voltage even if the number of serially connected LED devices increases. With this feature, the light volume of the LED light source can be changed in extent of wide range with high accuracy, and control of lighting and lighting-out LED devices can be performed at high speed.

Although certain preferred embodiments of the present invention have been shown and described in detail, it should be understood that the present invention is not limited to the above embodiments, and various changes and modifications may be made therein within the scope of the appended claims.

INDUSTRIAL APPLICABILITY

The present invention can be available to be used for a lighting equipment, which uses LED lighting source, LED radiating equipment, and so on.

The invention claimed is:

1. An LED driving circuit comprising:

a serially connected LED circuit, in which a plurality of LED devices are serially connected;

a switching device serially connected with the serially connected LED circuit to control turning on or off an electrical current flowing through the serially connected LED circuit; and a circuit device connected in parallel with the switching device causing a minute direct current flow through the serially connected LED circuit without turning on the LED devices when the switching device is off.

2. The LED driving circuit according to claim 1, wherein the circuit device comprises a resistor device.

3. The LED driving circuit according to claim 1, wherein the circuit device comprises a constant voltage diode device.

4. The LED driving circuit according to claim 1, wherein the circuit device comprises a constant current diode device.

5. The LED driving circuit according to claim 1, wherein the circuit device comprises a combination of a constant voltage diode device and a transistor to form a voltage limiting circuit, which has large electrical current capacity over a constant voltage.

6. An LED driving circuit comprising:

a serially connected LED circuit, in which n pieces of LED devices having forward voltage Vf respectively are serially connected;

a switching device serially connected with the serially connected LED circuit to control turning on or off an electrical current flowing through the serially connected LED circuit;

a DC power supply, in which power supply voltage Vcc is, Vcc>Vf×n; and a circuit device connected in parallel with the switching device causing a minute direct current flow through the serially connected LED circuit without turning on the LED devices when the switching device is off, wherein the switching device has a maximum voltage $V_{CEO}$, with $V_{CEO}$<Vcc.

* * * * *